US007994444B2

(12) United States Patent
Olszewski et al.

(10) Patent No.: US 7,994,444 B2
(45) Date of Patent: Aug. 9, 2011

(54) APPARATUS FOR MONITORING THE STATE OF AN ELECTRICAL SWITCHING DEVICE

(75) Inventors: Wojciech Olszewski, Berlin (DE); Peter Schmidt, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 627 days.

(21) Appl. No.: 11/664,493

(22) PCT Filed: Sep. 20, 2005

(86) PCT No.: PCT/EP2005/054680

§ 371 (c)(1),
(2), (4) Date: Apr. 2, 2007

(87) PCT Pub. No.: WO2006/037724

PCT Pub. Date: Apr. 13, 2006

(65) Prior Publication Data

US 2008/0105524 A1 May 8, 2008

(30) Foreign Application Priority Data

Oct. 1, 2004 (DE) ..... 10 2004 048 985

(51) Int. Cl.
*H01H 9/00* (2006.01)

(52) U.S. Cl. ..... 200/308

(58) Field of Classification Search ..... 200/308, 200/310, 312, 313
See application file for complete search history.

(56) References Cited

U.S. PATENT DOCUMENTS

| | | | |
|---|---|---|---|
| 6,080,947 A | 6/2000 | Ulerich et al. | |
| 6,107,902 A | 8/2000 | Zhang et al. | |
| 6,697,247 B1 * | 2/2004 | Meinherz et al. | 361/115 |

FOREIGN PATENT DOCUMENTS

| | | |
|---|---|---|
| DE | 8904138 U1 | 10/1989 |
| DE | 19955588 A1 | 5/2000 |
| DE | 19960399 B4 | 9/2004 |
| EP | 1066643 B1 | 2/2002 |
| FR | 2388391 A * | 12/1978 |

OTHER PUBLICATIONS

German Office Action dated Jun. 8, 2005.

* cited by examiner

*Primary Examiner* — Felix O Figueroa
(74) *Attorney, Agent, or Firm* — Laurence A. Greenberg; Werner H. Stemer; Ralph E. Locher

(57) ABSTRACT

An electrical switching device has a state indicator which is covered or uncovered in accordance with the state of the switching device. In order to reduce the amount of moved masses, the state indicator remains in a resting position during a switching process of the electrical switching device. The state indicator can be covered at least in part by the movable switching contact pieces of the electrical switching device, for example.

10 Claims, 4 Drawing Sheets

APPARATUS FOR MONITORING THE STATE OF AN ELECTRICAL SWITCHING DEVICE

BACKGROUND OF THE INVENTION

Field of the Invention

The invention relates to an apparatus for monitoring a state of an electrical switching device having a state indicator which is covered or uncovered as a function of the state of the switching device.

An apparatus such as this is known, for example, from German laid-open specification DE 199 55 588 A1. A known switching device is in the form of a circuit breaker and has a housing, a power supply system connection and a load connection. A switchable contact point is arranged between the power supply system connection and the load connection. When the electrical switching device trips, a so-called tripping stud is operated, and the switchable contact point of the known electrical switching device is opened. In order to allow the switching state of the switching device to be seen from the outside, a state indicator is provided. The state indicator is in the form of a rocker which can pivot. This rocker is pivoted as a function of the switching state of the known switching device, and can either be seen through a window or is pivoted behind a cover.

In addition to the force to be applied during a switching process for the movement of the switching contact piece of the switchable contact point of the switching device, a force must be applied in order to move the state indicator. In order to keep the additionally acquired force as small as possible, a lightweight structure is chosen for the state indicator. Furthermore the rotating bearing of the state indicator is subject to relatively high wear in the event of frequent switching. There is therefore a contradiction between a freely moving design of the state indicator in order to achieve a force-saving movement and reliable long-term bearing of the state indicator.

SUMMARY OF THE INVENTION

The invention is therefore based on the object of specifying an apparatus for monitoring a state of an electrical switching device, which has a state indicator which has a long life and ensures reliable indication of the switching state.

For an apparatus of the type mentioned initially, the object is achieved according to the invention in that the state indicator remains at rest during a switching process.

The switching processes in electrical switching devices often take place suddenly. A rapid switching process can also result in vibration, which extends over the entire switching device. If a state indicator which remains at rest during a switching process is chosen, shock and oscillation phenomena can no longer be superimposed on a movement of the state indicator. This improves the life of the state indicator. Since the movement of the switching contacts of the switching device is now decoupled from any movement that there may be of the state indicator, the necessary drive energy can be reduced. This allows energy stores to be reduced in size, and allows the kinematic chain for transmission of the movement to be designed in a less stringent manner.

A further advantageous refinement makes it possible to provide for the state indicator to image the switching state of the electrical switching device.

The switching contacts of an electrical switching device often cannot be seen directly. Sheaths such as arch splitter chambers or the like, impede a direct view. However, it is necessary for an operator or user of an electrical switching device to identify the switching state. This makes it possible, for example, to safely identify a disconnected cable section.

It is advantageously also possible to provide that a viewing axis for reading runs to the state indicator and is interrupted or cleared on the basis of a drive movement of a kinematic chain for driving of a switching contact piece.

The interruption of a viewing axis for reading the state indicator means that there is no need for complex design embodiments. In this case, for example, it is possible to provide for elements of the kinematic chain, such as rods, bolts, gearwheels, chains, flaps or the like, to be moved onto the viewing axis. Since, in a kinematic chain, a movement must be transmitted in order to move a movable switching contact piece of an electrical switching device, the movement associated with this of individual elements can be used in order to cover or to uncover the state indicator. This means that there is no need to fit any parts or masses, which additionally have to be moved, in the kinematic system.

A further advantageous refinement makes it possible to provide for the capability for the state indicator to be at least partially covered by a switching contact piece of the switching device.

If the switching contact pieces are used to cover the state indicator, very reliable state indication is ensured. Even in the event of a fault, for example bending of a lever in the kinematic chain in the drive run, the instantaneous switch position of the switching contact pieces can always be imaged. In this case, it is possible to provide for the movable switching contact pieces of a switching contact of the electrical switching device to move onto a viewing axis for reading the state indicator.

It is advantageously also possible to provide for the state indicator to be subdivided into a plurality of areas which can be covered.

The state indicator can be subdivided, for example, by the arrangement of a scale on which the progress of the switching process can be read. It is thus also easily possible to carry out a risk assessment, for example in the event of a malfunction or blocking of a movable switching contact piece during a switching process. Furthermore, it is also possible to provide for the state indicator to have different areas which, for example, are identified by markings of different colors, by coding in the form of letters, digits, barcodes or the like. This makes it possible to ensure that actual opening of the switching contact pieces is signaled only after specific sections have been uncovered. Furthermore, the state indicator can also be subdivided into various areas for a plurality of movable switching contact pieces, so that an area which can be covered separately is associated with each of the switching contact pieces.

A further advantageous refinement makes it possible to provide for the capability for the state indicator to be covered by a plurality of switching contact pieces.

When there are a plurality of switching contacts in an electrical switching device, for example in a three-phase version of a switching device, it is desirable to detect the switching state of all three switching contacts. An appropriate arrangement of the movable switching contact pieces, for example with a diagonal offset with respect to a viewing axis for reading of the state indicator, allows reliable monitoring of the switching state of the entire device. Even if each of the individual switching contact pieces has a separate drive, reliable monitoring is possible. It is thus possible to overcome the unreliability of a switching contact piece which is chosen as being representative to the switching state of all of the movable switching contact pieces. This now ensures that the state of each individual switching contact piece can be monitored.

A further advantageous refinement makes it possible to provide for the state indicator to be arranged within a compressed-gas-tight encapsulating housing.

Compressed-gas-tight encapsulating housings are generally manufactured from opaque material. If required, individual small viewing windows are incorporated in the encapsulating housing. By way of example, the viewing axis can pass through these viewing windows, in order to evaluate the state indicator.

Since this viewing axis need not be linked to specific apparatuses, such as cables and lines, there is no need to modify the design of the encapsulating housing. In this case, for example, the state indicator can be attached to a wall of the encapsulating housing, or the wall of the encapsulating housing itself may form a state indicator.

It is also advantageously possible to provide for the capability for the state indicator to be detected optically.

Optical detection of the state indicator is also possible just by the human eye, without the need for any technical apparatus that additionally need to be used. This allows highly cost-effective monitoring of the contact points of an electrical switching device. The electrical switching devices may, for example, be switch disconnectors, grounding switches, combined grounding/switch disconnectors, load interrupter switches, load interrupters or else circuit breakers. Subdivision of the state indicator into a plurality of areas allows quick and reliable reading.

A further refinement variant makes it possible to provide for the state indicator to be monitored by an optical sensor, in particular a camera.

The use of an optical sensor allows the information which can be read from the state indicator to be converted, and to be transported over long distances in an electronic form. This makes it possible, for example, to monitor the switching state of a switching device remotely at a control center. It is particularly advantageous in this case for a camera to be used as the optical sensor. The camera can be used to transmit a real image of switching contacts and state indicator to the control center. In addition to the monitoring of the state indicator, an additional coding can be arranged in the field receiver of the optical sensor. This coding may, for example, be a designation of the switching device, of the switchgear assembly, of a location or the like. This makes it possible to easily obtain an overview, even for remote control and/or monitoring. This reduces the risk of incorrect switching operations. Even if the data in a camera image is processed electronically, the information relating to the switching point and the additional coding, remains stored in an associated form. Furthermore, optical detection also makes it possible to diagnose the state of the switching contact. For example, this allows increased material wear or else increased erosion of contact areas to be identified.

In addition, one advantageous refinement makes it possible to provide for the state indicator to be an area marking.

An area marking allows the state indicator to be read easily and reliably even from a distance. Area markings can easily be attached to housing walls. As such, they cost little. There is therefore no need for any additional indicating elements.

The invention will be described in more detail in the following text, and is illustrated schematically in a drawing, on the basis of one exemplary embodiment.

In this case,

DESCRIPTION OF THE PREFERRED EMBODIMENTS

Figure 1:
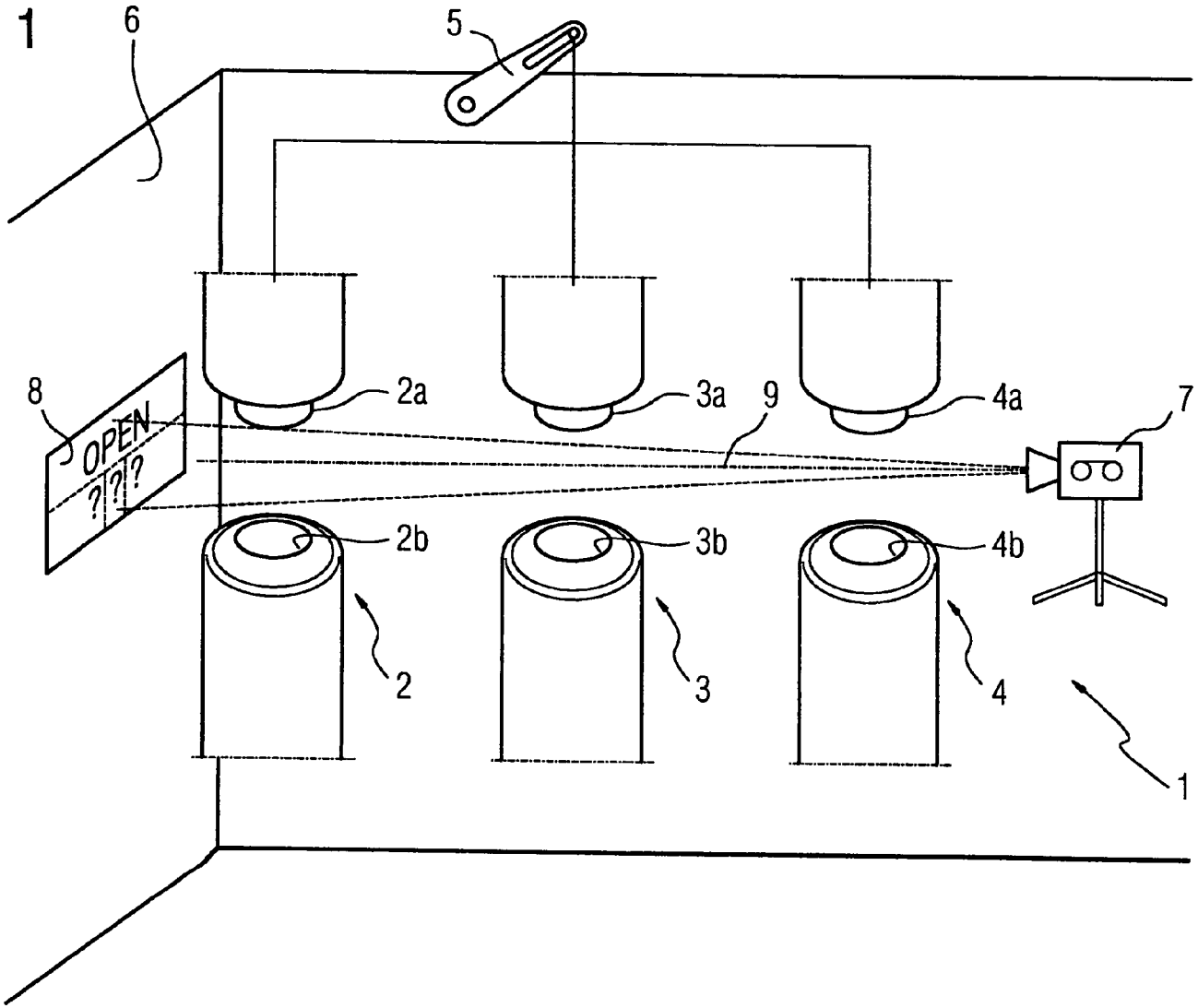
FIG. 1 shows three switching contacts of an electrical switching device in an open position.
Figure 2:
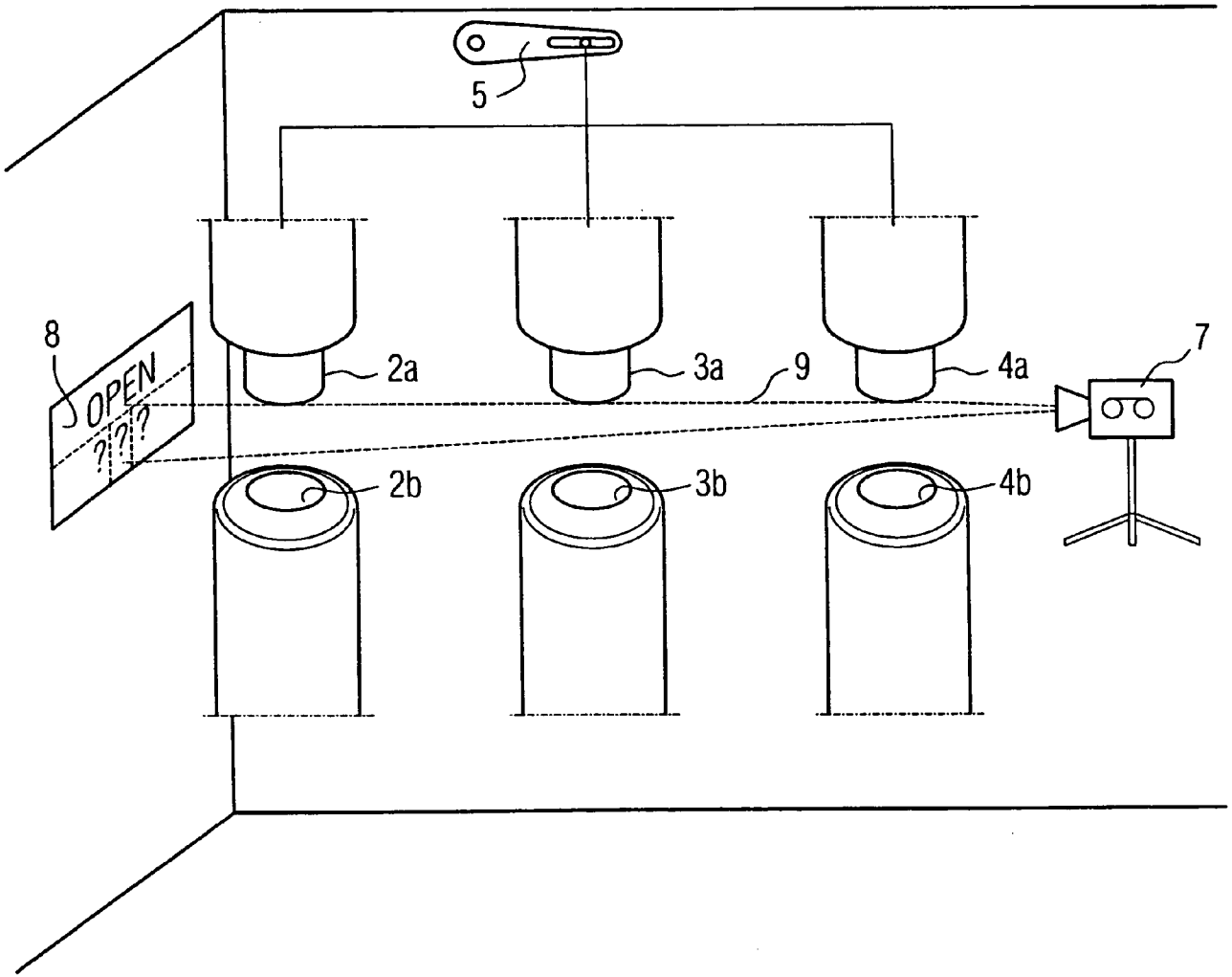
FIG. 2 shows the three switching contacts of the electrical switching device in an intermediate position.

The figures show an electrical switching device 1. The electrical switching device 1 has a first, a second and a third switching contact 2, 3, 4. The first switching contact 2 has a first movable switching contact piece 2*a* as well as a first mating contact piece 2*b*. In the same way, the second and the third switching contact 3, 4 each have a respective movable switching contact 3*a*, 4*a* as well as a fixed mating contact piece 3*b*, 4*b*. The movable contact pieces 2*a*, 3*a*, 4*a* are in the form of bolts. The mating contact pieces 2*b*, 3*b*, 4*b* are tubular. The movable switching contact pieces 2*a*, 3*a*, 4*a* move into the tubular mating contact pieces 2*b*, 3*b*, 4*b* during a connection process. The movable switching contact pieces 2*a*, 3*a*, 4*a* can be moved via a kinematic chain which has a lever 5 that can pivot. The lever 5 that can pivot can be pivoted, for example, by means of an electromagnetic drive or a spring energy store drive. The switching device 1 is arranged within an encapsulating housing 6. The encapsulating housing 6 is a compressed-gas-tight housing which surrounds the switching contacts 2, 3, 4. The interior of the encapsulating housing 6 is filled with an insulating gas, for example $SF_6$ or $N_2$, at an increased pressure. An optical sensor 7 in the form of a camera is arranged within the encapsulating housing 6. Alternatively, it is also possible to provide for the camera 7 to be arranged outside the encapsulating housing 6, and to look through a viewing window into the interior of the arrangement. The camera 7 covers the switching area of the three movable switching contact pieces 2*a*, 3*a*, 4*a*. A state indicator 8 is arranged behind the movable switching contact pieces 2*a*, 3*a*, 4*a* in the viewing direction of the camera 7. In the present example, the state indicator 8 is arranged on the inner wall of the encapsulating housing 6. The state indicator 8 is in the form of an area, and has a plurality of separate areas. The areas on the one hand have colored markings and on the other hand are provided with an alpha numeric inscription. When the switching contacts 2, 3, 4 are open, as illustrated in FIG. 1, a viewing axis 9 of the camera 7 points at the state indicator, without any obstruction. The area. which is marked with the designation "OPEN" can be seen by the camera 7. During a switching process, the movable switching contact pieces 2*a*, 3*a*, 4*a* move in the direction of the mating contact pieces 2*b*, 3*b*, 4*b*. As the movement of the movable switching contact pieces 2*a*, 3*a*, 4*a* in the direction of the mating contact pieces 2*b*, 3*b*, 4*b* continues, the viewing axis 9 of the camera is interrupted. In consequence, the camera 7 can now see only individual areas of the state indicator 8. In the intermediate position that is illustrated in FIG. 2 and which also, for example, corresponds to a fault position, the free viewing access 9 now reveals only the area provided with "???". The area provided symbolically with "???" indicates that the switching state is unclear at this time.

Figure 3:
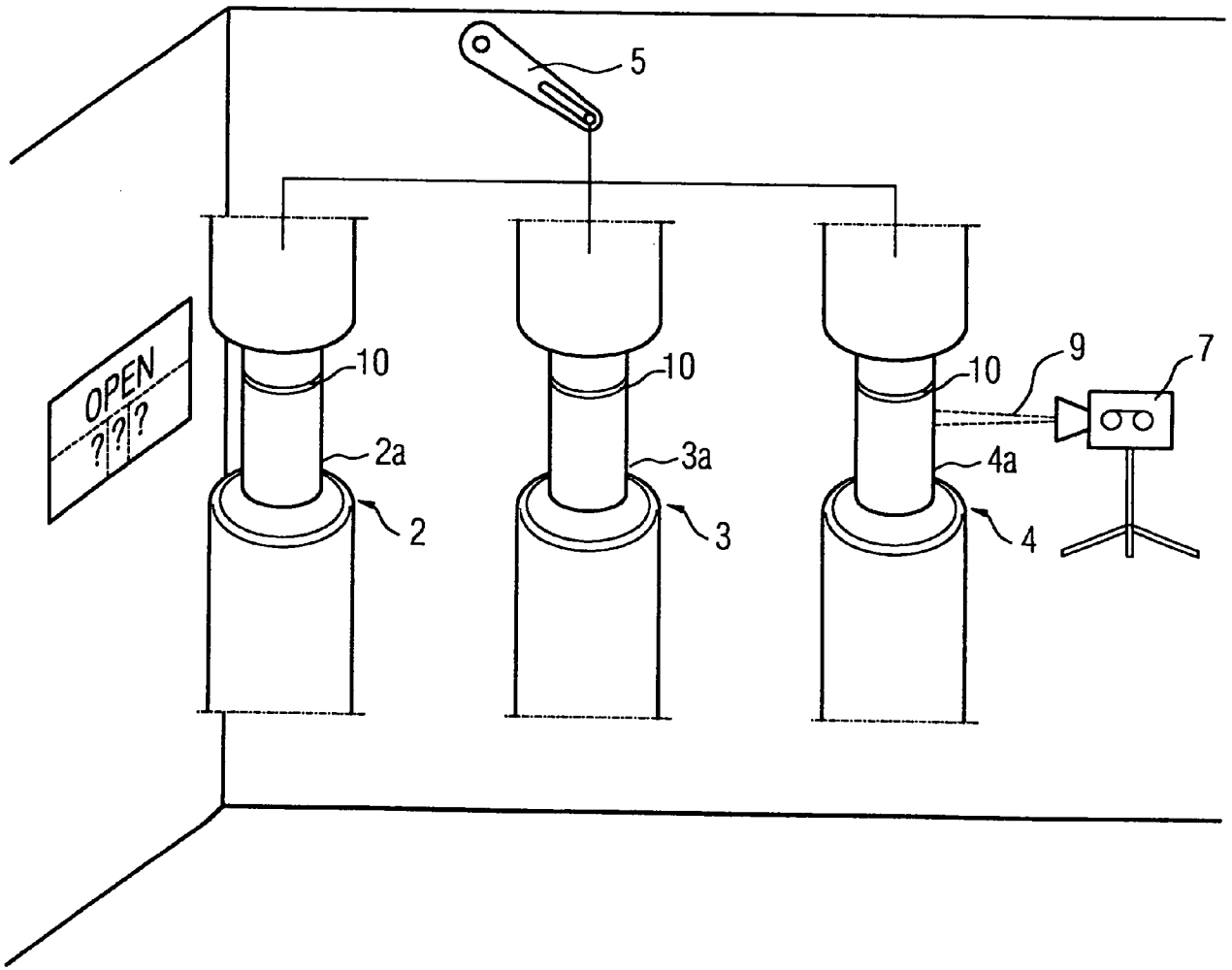
FIG. 3 shows the three switching contacts of the electrical switching device in a closed position.

When the switching contacts 2, 3, 4 are in the connected state as shown in FIG. 3, the viewing axis 9 of the camera 7 is completely covered by the movable switching contact pieces 2*a*, 3*a*, 4*a*. The state indicator 8 can now no longer be seen. In addition, it is possible to provide for markings 10, such as grooves, colored rings or similar indicating apparatuses to be applied to the movable switching contact pieces. These can be seen only when the movable switching contact pieces 2*a*, 3*a*, 4*a* have reached a reliable connected position.

Alternatively, it is also possible to provide for the optical sensor, in particular the camera 7, to cover the position of the lever 5 that can pivot or of some other part of the kinematic chain, and for the viewing axis of the camera to be covered by the lever 5 that can pivot. The state indicator 8 must then also be appropriately aligned and adjusted.

Figure 4:
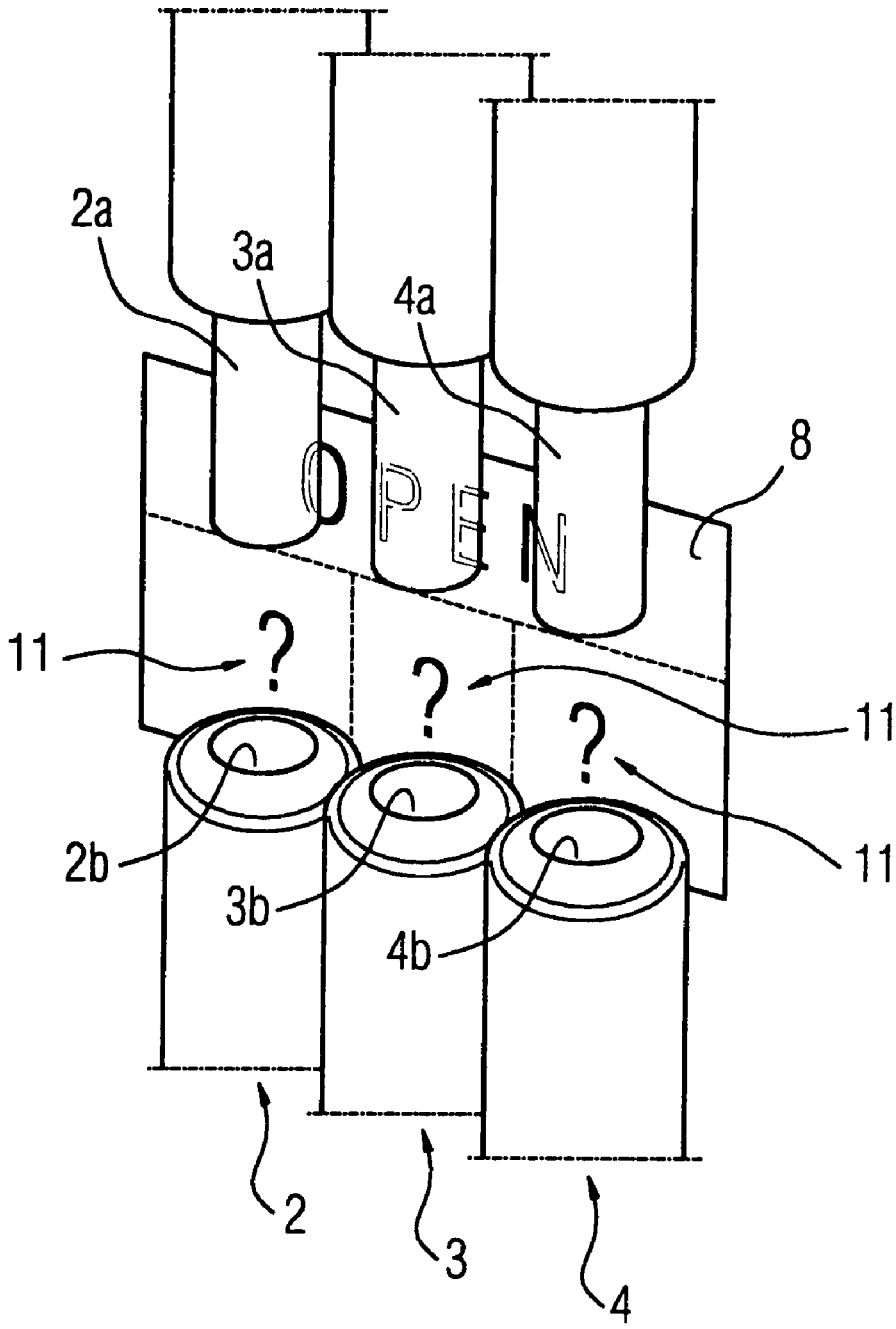
FIG. 4 shows the three switching contacts of the electrical switching device in the intermediate position, in the direction of a viewing axis for reading a state indicator.

FIG. 4 shows a perspective view of the intermediate position of the movable switching contact pieces 2*a*, 3*a*, 4*a*. The perspective view corresponds to the viewing axis of the camera 7. This shows, for example, partial coverage of the state indicator 8. Furthermore, when the switching contacts 2, 3, 4 are aligned in a manner such as this, the state indicator 8 can be subdivided into further zones 11, in which case each of the further zones 11 can respectively be associated with one of the movable switching contact pieces 2*a*, 3*a*, 4*a*. This makes it possible to check that each of the switching contacts is in its reliable connected or disconnected position. Furthermore, an additional coding can be applied in the area covered by the camera, for example containing information about the location, the switch type, the switchgear assembly, etc.

We claim:

1. An apparatus for monitoring a switching state of an electrical switching device having at least one switching contact piece, the apparatus comprising:

a switching state indicator disposed to be covered or uncovered in dependence on a switching state of the switching device, said state indicator remaining at rest during a switching process of the switching device, wherein said state indicator is divided into a plurality of areas that can be covered by the switching contact piece of the electrical switching device; and an optical sensor disposed to monitor said plurality of areas of said state indicator in order to determine whether the switching contact piece of the electrical switching device is open, closed, or in an intermediate position.

2. The apparatus according to claim 1, wherein said state indicator is configured to image a switching state of the electrical switching device.

3. The apparatus according to claim 1, wherein said state indicator is disposed to read along a viewing axis and the viewing axis is interrupted or cleared based on a drive movement of a kinematic chain for driving a switching contact piece of the electrical switching device.

4. The apparatus according to claim 1, wherein said state indicator can be at least partially covered by a switching contact piece of the electrical switching device.

5. The apparatus according to claim 4, wherein said state indicator can be covered by a plurality of switching contact pieces.

6. The apparatus according to claim 1, wherein said state indicator is disposed within a compressed-gas-tight encapsulating housing.

7. The apparatus according to claim 1, wherein said state indicator can be detected optically.

8. The apparatus according to claim 1, wherein said optical sensor is a camera.

9. The apparatus according to claim 1, wherein said state indicator is an areal marking.

10. The apparatus according to claim 1, wherein the electrical switching device has a plurality of switching contact pieces and said optical sensor is disposed to monitor said plurality of areas of said state indicator in order to determine whether the plurality of switching contact pieces of the electrical switching device are open, closed, or in an intermediate position.

* * * * *